United States Patent [19]

Maeder

[11] Patent Number: 5,065,906

[45] Date of Patent: Nov. 19, 1991

[54] DOUBLE-CHAMBERED CARTRIDGE HAVING SEMI-CYLINDRICAL PISTONS FOR USE IN A PRESS-OUT GUN

[76] Inventor: August Maeder, Hurdnerwaeldli Strasse 42, 8808 Pfaeffikon/Sz, Switzerland

[21] Appl. No.: 421,169

[22] Filed: Oct. 13, 1989

[30] Foreign Application Priority Data

Oct. 14, 1988 [DE] Fed. Rep. of Germany ..... 3835093

[51] Int. Cl.[5] ..... B65D 83/00

[52] U.S. Cl. ..... 222/137; 222/327

[58] Field of Search ..... 222/135-137, 222/145, 276, 269, 325-327, 386

[56] References Cited

U.S. PATENT DOCUMENTS

| | | | |
|---|---|---|---|
| 3,166,221 | 1/1965 | Nielsen | 222/386 |
| 3,250,443 | 5/1966 | Abbott, Jr. | 222/327 |
| 3,279,654 | 10/1966 | Pierick | 222/137 |
| 3,323,682 | 6/1967 | Creighton, Jr. et al. | 222/137 |
| 4,030,643 | 6/1977 | van Manen | 222/386 |
| 4,169,547 | 10/1979 | Newell | 222/386 |
| 4,179,050 | 12/1979 | Farrell, III et al. | 222/386 |
| 4,269,330 | 5/1981 | Johnson | 222/386 |
| 4,366,919 | 1/1983 | Anderson | 222/137 |
| 4,452,370 | 6/1984 | Langensiepen et al. | 220/93 |
| 4,854,485 | 8/1989 | Collins | 222/386 |
| 4,913,553 | 4/1990 | Falco | 222/137 |

FOREIGN PATENT DOCUMENTS

| | | | |
|---|---|---|---|
| 8714548 | 2/1988 | Fed. Rep. of Germany . | |
| 3814633 | 8/1989 | Fed. Rep. of Germany . | |
| 659629 | 2/1987 | Switzerland | 222/386 |

*Primary Examiner*—Michael S. Huppert
*Assistant Examiner*—Anthoula Pomrening
*Attorney, Agent, or Firm*—Foley & Lardner

[57] ABSTRACT

An apparatus for extruding the stored fluid contents of a single cylindrical cartridge which has a side wall and a longitudinal partition wall which defines semicylindrical chambers within the cartridge, the apparatus comprising a cylindrical tube which has a closed end wall and an open end with an end with a bevelled edge. A pair of semicylindrical sleeve pistons are concentrically positioned in a spaced parallel relation within the tube, with the space between the pistons being coplanar with the partition wall to permit the sliding of the tube longitudinally along the external periphery of the cartridge. The pistons are each mounted on the closed end wall, within the tube, and include upstanding free ends which are adapted to engage corresponding slidable semicircular plungers that function as seals within the corresponding chambers of the cartridge. Both the cartridge and cylindrical tube are inserted into the hollow body of a conventional caulking gun, wherein external mechanical pressure is applied to the closed end of the tube. As the tube slides forward along the cartridge, in closely fitted relation therewith, the side wall of the cartridge is prevented from expanding due to the internal pressures, and the contents of the cartridge are expelled through a pair of outlet openings in accurately predetermined quantities.

6 Claims, 2 Drawing Sheets

DOUBLE-CHAMBERED CARTRIDGE HAVING SEMI-CYLINDRICAL PISTONS FOR USE IN A PRESS-OUT GUN

FIELD OF THE INVENTION

This invention relates to an apparatus for extruding the contents of a dual-chamber fluid dispensing cartridge and more particularly to such an apparatus that is operably compatible with a conventional extrusion gun.

BACKGROUND OF THE INVENTION

Extrusion guns, also referred to as caulking and press-out guns, are commonly used to dispense a fluid substance stored in a dispensing cartridge. The usual structure of the caulking gun comprises a generally semicylindrical body into which the dispensing cartridge is inserted. A hand operated trigger grip mounted at one end of the body is adapted to drive a displaceable piston-rod and a circular pressure plate longitudinally along the length of the body in order to discharge the contents from the dispensing cartridge. Usually a discharge nozzle extends from the cartridge through an open end of the body opposite the trigger grip. The dispensing cartridge is placed within the caulking gun such that the pressure plate, which is mounted at the forward end of the piston-rod, is fitted within an open end of the cartridge against a plunger therein. Operation of the trigger grip moves the piston rod forward, causing the fluid within the cartridge to be discharged from the nozzle. While useful with a single-chamber cartridge, a limitation of the conventional caulking gun is that it is unable to discharge the contents of a dispenser cartridge having dual chambers within which are stored separate fluid substances.

A dual-chamber cartridge of the foregoing type is described in applicant's West German patent application DE-OS 38 14 633.9. The application discloses a container for fluid substances comprising a cylindrical housing that is divided into two chambers by means of a partition wall positioned along the longitudinal axis of the housing whereby each chamber includes a closed end having an outlet opening and an open opposite end within which is positioned a semicircular shaped plunger that is slidably displaceable towards the outlet opening. One side of the plunger includes several reinforcement ribs, and along the peripheral edge of the plunger there is a lip seal which forms an integral part of the plunger.

In West German patent application DE-GM 87 14 548 there is disclosed a manually operable caulking gun, similar to the caulking gun heretofore described, for discharging fluid substances stored inside of a dual-chamber dispensing cartridge. A transport rod and a piston rod fixed to a yoke are each fitted with a semicircular pressure plate at their respective front ends. Both rods are arranged in a parallel relation such that when operating the trigger grip mechanism of the caulking gun, both the transport rod and the piston-rod are moved forward together, thereby discharging the two components that are stored in the dual chambers of the dispenser cartridge. A disadvantage of this known caulking gun arises from the fact that there may be an expansion of the dispenser cartridge side wall due to an interior high pressure that is created when discharging the components of the dual-chamber cartridge. The cartridge appears to be particularly prone to this problem since its side wall is often made from a flexible material and also because the cartridge is usually only loosely fitted within the housing of the caulking gun, thereby leaving space for side wall expansion. As a result, the fluid contents of the dispenser cartridge may be lost by flowing back into the spaces behind the pressure plates.

SUMMARY OF THE INVENTION

Having regard for the aforedescribed problems relating to dual-chambered dispensing cartridges and the extrusion guns which are adapted to be used with this, a principle provision of the present invention provides an extrusion apparatus that is operably compatible with a conventional caulking gun for extruding fluids from a dual-chamber dispensing cartridge.

Another provision of the invention provides an extrusion apparatus which assures a precise and uniform simultaneous discharge of fluids stored in the dual chambers of the dispensing cartridge.

Yet another provision of the invention provides an extrusion apparatus that prevents irregular expansion of the side wall of the dispensing cartridge when internal pressure is applied thereto.

The problems associated with the prior art may be substantially overcome and the foregoing objectives achieved by recourse to the invention which relates to an apparatus for extruding the stored fluid contents of a single cylindrical cartridge which has a side wall and a longitudinal partition wall which defines dual semicylindrical chambers within the cartridge. In addition, each chamber has corresponding closeable outlet openings and corresponding inlet openings which are closed by corresponding plungers slidably disposed therein. The apparatus comprises a cylindrical tube having an open end, a side wall adapted to slidably engage the external periphery of the cartridge in a closely fitted relation, a closed end defined by an end wall, and a pair of pistons upstanding from the end wall and disposed within the interior of the tube. The pistons are spaced apart with the space there between being coplanar with the partition wall to permit the sliding of the tube longitudinally along the cartridge.

BRIEF DESCRIPTION OF THE DRAWINGS

The invention will now be more particularly described with reference to an embodiment thereof shown, by way of example, in the accompanying drawings in which.

DETAILED DESCRIPTION OF A PREFERRED EMBODIMENT

Figure 1:
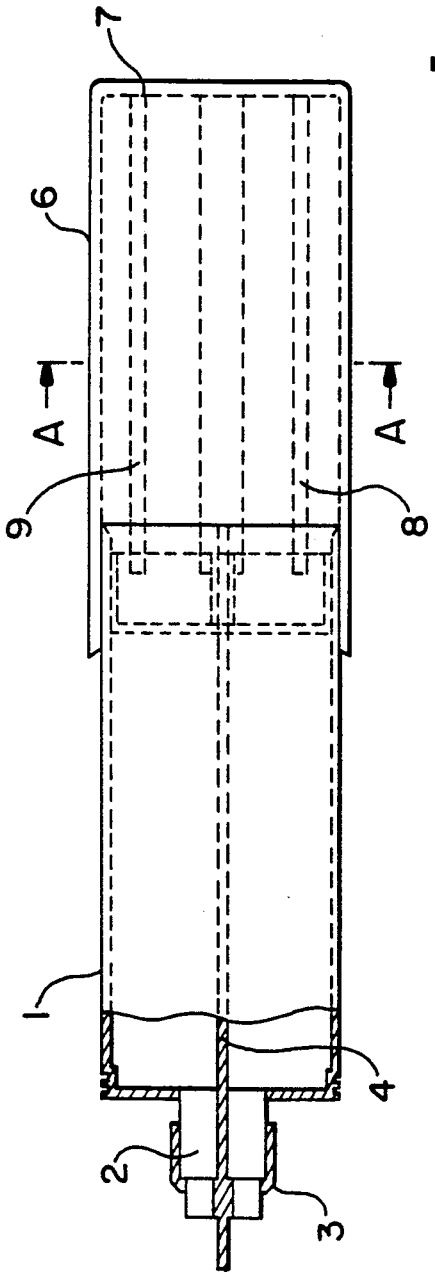
FIG. 1 is a side elevation view of an extrusion apparatus in accordance with the invention shown engaging one end of a dual-chamber fluid storage and dispensing cartridge illustrated partially in cross-section.

Illustrated in FIG. 1 is a side elevation view of a dual chamber fluid storage and dispensing cartridge 1, shown partly in cross-section, which has two outlet openings 2 and 3 defined by side walls that form a discharge nozzle. A mixing nozzle (not shown) is adapted to be mounted on the discharge nozzle in a known manner. It will be observed that the cartridge 1 is divided into two semicylindrical chambers by means of a partition wall 4 that is positioned centrally within cartridge 1 along its longitudinal axis. With the openings 2 and 3 closed by means of a known closure cap, the chambers may be separately filled with a fluid substance for storage and subsequent dispensing as required. When filled, a bottom end of the cartridge 1 is sealed by means of two semicircular plungers 5 which are slidably displaceable within the chambers and which can move from the bottom end towards the openings 2 and 3.

Figure 3B:
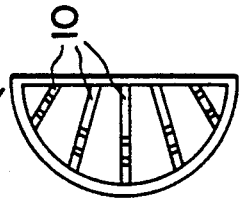
FIG. 3*b* is a bottom plan view of the plunger of FIG. 3*a*.
Figure 3A:
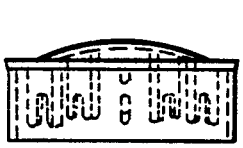
FIG. 3*a* is a side elevation view of a plunger used in the apparatus of FIG. 1.

A side elevation view of a plunger 5 is shown in FIG. 3*a* wherein it will be understood that a convexly shaped portion thereof faces the stored contents of the cartridge 1. A bottom plan view of the plunger 5 appears in FIG. 3*b* wherein it will be observed that the plunger is formed with a plurality of notched radially extended reinforcement ribs 10.

The separate contents stored in the cartridge 1 may be discharged in a precise and uniform manner by means of a cylindrical tube 6 that is configured in accordance with the precepts of the invention described hereinbelow in greater detail. It is shown in FIG. 1 that the tube 6 is open at one end and is adapted to slidably engage the external side wall periphery of the cartridge 1. The side wall edges which define the open end of the tube 6 are bevelled to act as a guide along the side wall of the cartridge 1. Mounted within the tube 6 and forming an integral part thereof are a pair of pistons 8 and 9.

Figure 4:
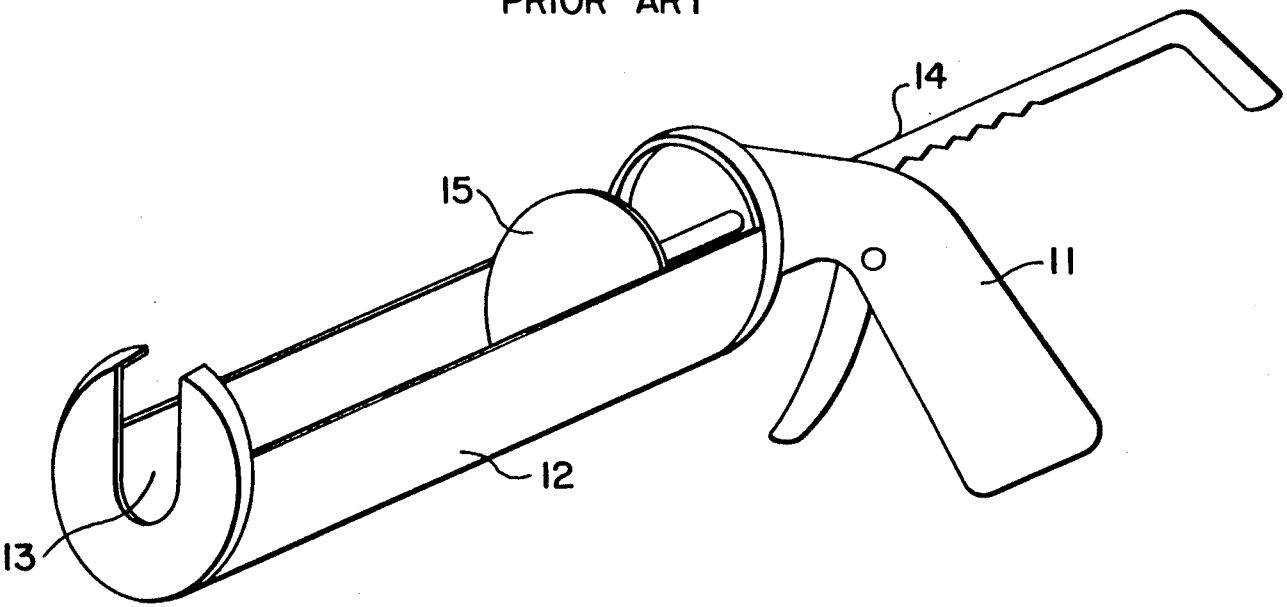
FIG. 4 PRIOR ART
FIG. 4 is a perspective view of a conventional press-out gun.

It is understood that the cartridge 1 and tube 6 arrangement of FIG. 1 is adapted to be place within a conventional press-out gun, such as a caulking gun, shown in FIG. 4, to effect operation. As previously described, and as is known in the art, the gun comprises a manually operable trigger grip 11, a semicylindrical body 12 having an open end 13, and a piston-rod 14 that is longitudinally displaceable within the body by means of a mechanical coupling arrangement with the trigger grip. As heretofore noted, a circular pressure plate 15 is attached to the free end of the piston-rod 14 and is displaced with the piston-rod 14 to force the contents out of the cartridge 1 in a known manner. In this regard, the tube 6 is shown with a closed bottom end 7 which faces the circular pressure plate 15 of the conventional press-out gun. Pressure applied by the press-out gun to the end 7 forces the tube 6 to slidably engage the cartridge 1 and subsequently brings the free ends of the pistons 8 and 9 into contact with the ribs 10 of corresponding plungers 5. Since the pistons 8 and 9 are shorter in overall length than the side wall of the tube 6, it is understood that the interior cylindrical surface or the tube 6 initially engages the exterior cylindrical surface of the cartridge 1 before there is contact between the pistons 8 and 9 and the ribs 10. Thus, contact between the pistons 8 and 9 and the ribs 10 is delayed. As the tube 6 moves forward, the plungers 5 correspondingly move forward towards the openings 2 and 3 discharging the stored contents of the cartridge 1.

Since the side wall portion defining the open end of the tube 6 leads the free ends of the pistons 8 and 9, the corresponding side wall portion of the cartridge 1 is circumscribed by the tube 6 before pressure is exerted from within the cartridge 1. As a result, the pressurized side wall portion of the cartridge 1 is confined by the circumscribing wall of the tube 6 to prevent expansion of the cartridge side wall. This structural feature facilitates a precise and uniform discharge of the contents from the cartridge 1.

Figure 2:
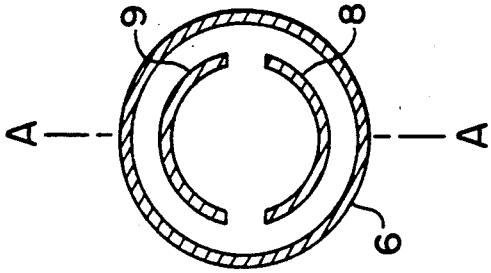
FIG. 2 is a cross-sectional view of FIG. 1 taken along the lines A—A.

As best seen from the cross-sectional view presented in FIG. 2, the pistons 8 and 9 are configured as semicylindrical sleeves which are sufficiently spaced apart so that the wall 4 is coplanar with and can readily slide within the space provided between the pistons.

The tube 6 may advantageously be fabricated from any suitable material, such as aluminum or plastics, that will maintain the structural integrity of the tube 6 so as to fit closely to the interior diameter of the body of the press-out gun and the external diameter of the cartridge 1.

The embodiments of the invention in which an exclusive property or privilege is claimed are defined as follows:

1. An apparatus for extruding stored fluid contents of a single cylindrical cartridge having a side wall and a longitudinal partition wall defining dual semicylindrical chambers, each chamber having corresponding closeable outlet openings and corresponding inlet openings which are closed by corresponding plungers slidably disposed therein, comprising:

a cylindrical tube having an open end, a side wall adapted to slidably engage the external periphery of the cartridge in a closely fitted relation, and a closed end having an end wall; and a pair of pistons each being in the form of a semicylindrical sleeve upstanding from the end wall and disposed concentrically inside the cylindrical tube, the pistons being spaced apart defining a space therebetween, the space being coplanar with the partition wall to permit sliding of the tube longitudinally along the cartridge.

2. An apparatus as claimed in claim 1 wherein the pistons are substantially equal in length and shorter than the overall length of the cylindrical tube.

3. An apparatus as claimed in claim 2, wherein the external diameter of the cylindrical tube is selected to fit within the dispensing body of a press-out gun and the closed end wall of the tube is adapted to engage a circular pressure plate mounted on a free end of a longitudinally displaceable piston-rod of the gun.

4. An apparatus as claimed in claim 3, wherein the edge of the side wall defining the open end of the cylindrical tube is bevelled inwardly to form a guide that facilitates the sliding engagement of the cylindrical tube with the cartridge.

5. An apparatus for extruding stored fluid contents of a single cylindrical cartridge having a side wall and a longitudinal partition wall defining dual semicylindrical chambers, each chamber having corresponding closeable outlet openings and corresponding inlet openings which are closed by corresponding plungers slidably disposed therein, comprising:

a cylindrical tube having an open end, a side wall adapted to slidably engage the external periphery of the cartridge in a closely fitted relation, and a closed end having an end wall; and a pair of pistons upstanding from the end wall and disposed inside the tube, the pistons being spaced apart defining a space therebetween, the space being coplanar with the partition wall to permit sliding of the tube longitudinally along the cartridge;

wherein each piston is in the form of a semicylindrical sleeve disposed concentrically within the cylindrical tube;

wherein the pistons are substantially equal in length and shorter than the overall length of the cylindrical tube;

wherein the external diameter of the cylindrical tube is selected to fit within the dispensing body of a press-out gun and the closed end wall of the tube is adapted to engage a circular pressure plate mounted on a free end of a longitudinally displaceable piston-rod of the gun;

wherein the edge of the side wall defining the open end of the cylindrical tube is bevelled inwardly to form a guide that facilitates the sliding engagement of the cylindrical tube with the cartridge;

wherein each plunger is semicircular in form and includes a plurality of radial reinforcement ribs that are notched to receive the free end of a corresponding piston.

6. An apparatus as claimed in claim 5, wherein the cylindrical tube is fabricated from aluminum and the pistons are formed integrally therewith.

* * * * *